US008899314B2

(12) United States Patent
Tebay

(10) Patent No.: US 8,899,314 B2
(45) Date of Patent: Dec. 2, 2014

(54) STUFFING BOX

(75) Inventor: Derek Tebay, Lloydminster (CA)

(73) Assignee: Brightling Equipment Ltd., Lloydminster, Alberta (CA)

( * ) Notice: Subject to any disclaimer, the term of this patent is extended or adjusted under 35 U.S.C. 154(b) by 217 days.

(21) Appl. No.: 13/367,157

(22) Filed: Feb. 6, 2012

(65) Prior Publication Data

US 2013/0199773 A1 Aug. 8, 2013

(51) Int. Cl.
*E21B 33/02* (2006.01)

(52) U.S. Cl.
USPC ..... 166/84.4; 166/84.1; 166/68.5

(58) Field of Classification Search
USPC ..... 166/84.1, 84.4, 84.5, 92.1, 68.5, 84.2, 166/84.3
See application file for complete search history.

(56) References Cited

U.S. PATENT DOCUMENTS

| | | | | |
|---|---|---|---|---|
| 4,364,571 | A | 12/1982 | Hershey | |
| 5,346,004 | A | 9/1994 | Borden et al. | |
| 5,551,708 | A | 9/1996 | Vesey et al. | |
| 6,457,529 | B2 * | 10/2002 | Calder et al. | 166/368 |
| 6,776,419 | B2 | 8/2004 | Antoun | |
| 6,834,717 | B2 * | 12/2004 | Bland | 166/78.1 |
| 7,044,217 | B2 | 5/2006 | Hult | |
| 7,255,163 | B2 * | 8/2007 | Rivard | 166/84.1 |
| 7,343,969 | B1 | 3/2008 | Busch et al. | |

FOREIGN PATENT DOCUMENTS

| | | |
|---|---|---|
| CA | 2162311 | 12/1998 |
| CA | 2193482 | 8/2002 |
| CA | 2350047 | 10/2010 |

* cited by examiner

*Primary Examiner* — Robert E Fuller
(74) *Attorney, Agent, or Firm* — Anthony R. Lambert

(57) ABSTRACT

A stuffing box for a wellhead comprises a stationary housing defining a passage for receiving a well tubular, and a tubular shaft mounted on the stationary housing for rotation within the passage and defining an inner axial bore. The inner axial bore is adapted to form a static seal around the well tubular in use, and a dynamic pressure seal is mounted within an annular cavity defined by respective cylindrical surfaces of the stationary housing and the tubular shaft. One or both of the respective cylindrical surfaces are tapered to decrease the radial cross sectional area of a seal travel portion of the annular cavity in an axial direction from a well end of the stationary housing to an opposite second end of the stationary housing.

15 Claims, 5 Drawing Sheets

STUFFING BOX

TECHNICAL FIELD

This document relates to stuffing boxes for wellheads.

BACKGROUND

Stuffing boxes are used in the oilfield to form a seal between the wellhead and a well tubular passing through the wellhead, in order to prevent leakage of wellbore fluids between the wellhead and the piping. Stuffing boxes may be used in a variety of applications, for example production with pump-jacks, and inserting or removing coiled tubing. Stuffing boxes exist that incorporate a tubular shaft mounted for rotation in the housing for forming a stationary seal with the piping in order to rotate with the piping. The tubular shaft in turn dynamically seals with the stuffing box housing. Designs of this type of stuffing box can be seen in U.S. Pat. No. 7,044,217 and CA 2,350,047.

Leakage of crude oil from a stuffing box is common in some applications, due to a variety of reasons including abrasive particles present in crude oil and poor alignment between the wellhead and stuffing box. Leakage costs oil companies money in service time, down-time and environmental clean-up. It is especially a problem in heavy crude oil wells in which oil may be produced from semi-consolidated sand formations where loose sand is readily transported to the stuffing box by the viscosity of the crude oil. Costs associated with stuffing box failures are some of the highest maintenance costs on many wells.

SUMMARY

A stuffing box for a wellhead, the stuffing box comprising: a stationary housing defining a passage for receiving a well tubular; a tubular shaft mounted on the stationary housing for rotation within the passage and defining an inner axial bore adapted to form a static seal around a well tubular in use; and a dynamic pressure seal mounted within an annular cavity defined by respective cylindrical surfaces of the stationary housing and tubular shaft, in which one or both of the respective cylindrical surfaces are tapered to decrease the radial cross sectional area of a seal travel portion of the annular cavity in an axial direction downstream from a well end of the stuffing box.

In various embodiments, there may be included any one or more of the following features: The respective cylindrical surface of the tubular shaft is outward facing and the respective cylindrical surface of the stationary housing is inward facing. The respective cylindrical surface of the tubular shaft is tapered outwardly in an axial direction downstream from the well end. The respective cylindrical surface of the tubular shaft is inward facing and the respective cylindrical surface of the stationary housing is outward facing. The stuffing box comprises a seal positioner for adjustment of the position of the dynamic pressure seal within the annular cavity. The seal positioner comprises a piston. The seal positioner is upstream of the dynamic pressure seal. The seal positioner comprises a wedge. The seal positioner is a hydraulic seal positioner. The seal positioner further comprises a threaded rod mounted in the stationary housing. The hydraulic seal positioner has a hydraulic fluid input in the stationary housing. The stuffing box is adapted for production of wellbore fluids. The stuffing box is adapted for use in a progressing cavity pump application. The dynamic pressure seal comprises a lip seal. The stuffing box comprises bearings between the stationary housing and the tubular shaft.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

In FIGS. 7A-B, the annular cavity is defined by the tubular shaft and an inner standpipe of the stationary housing. FIGS. 7A-D illustrate embodiments where the outward facing cylindrical surface of the stationary housing is tapered (FIG. 7A), the inward facing cylindrical surface of the tubular shaft is tapered (FIG. 7B), the inward facing cylindrical surface of the stationary housing is tapered (FIG. 7C), and both cylindrical surfaces of the tubular shaft and stationary housing are tapered (FIG. 7D).

DETAILED DESCRIPTION

Immaterial modifications may be made to the embodiments described here without departing from what is covered by the claims.

Figures 1A, 1B:
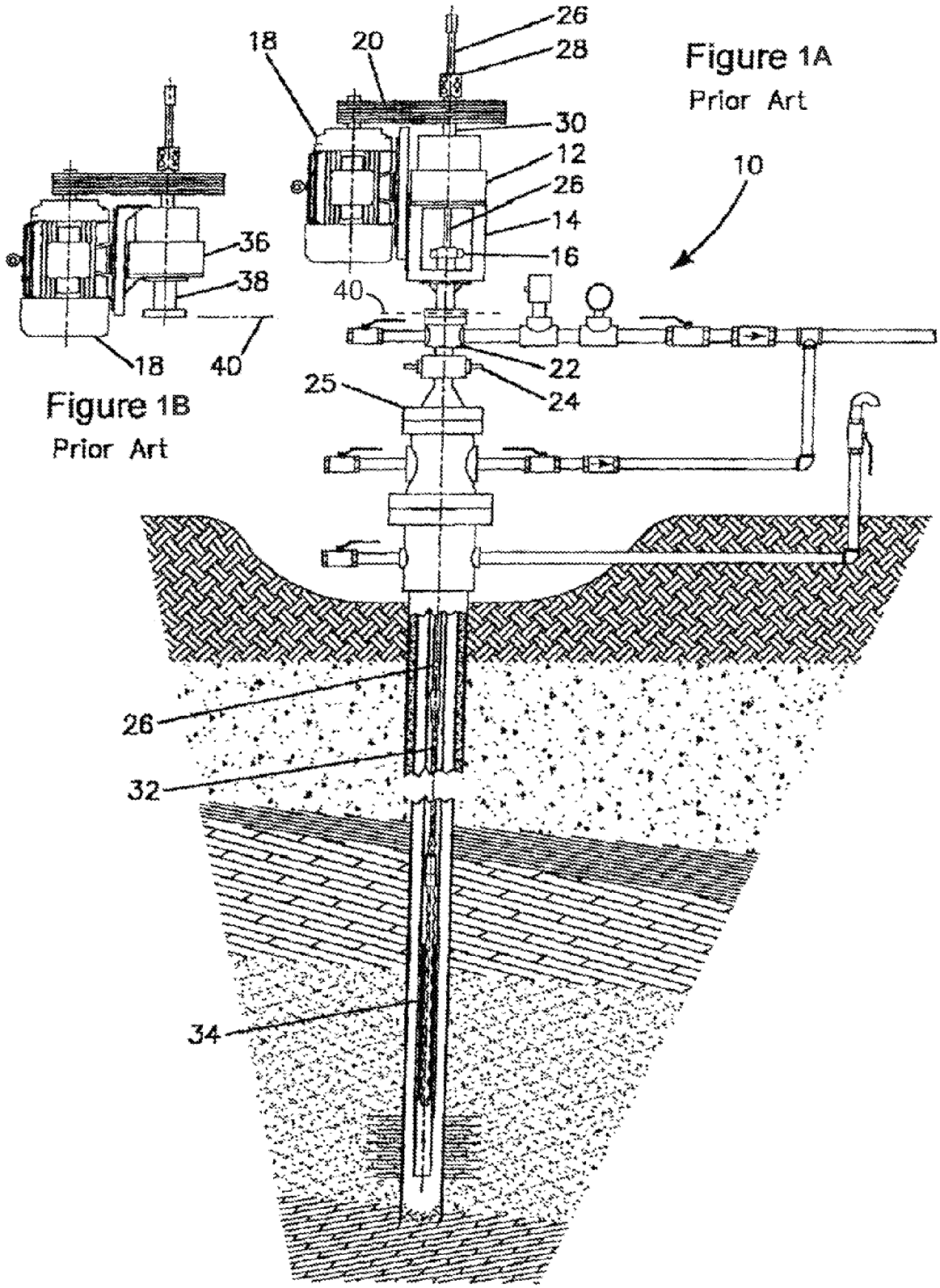
Figure 1A Prior Art
Figure 1B Prior Art
FIG. 1A is a view of a progressing cavity pump oil well installation in an earth formation for production with a typical drive head, wellhead frame and stuffing box.
FIG. 1B is a view similar to the upper end of FIG. 1 but illustrating a conventional drive head with an integrated stuffing box extending from the bottom end of the drive head.

FIG. 1A illustrates a known progressing cavity pump installation 10. The installation 10 includes a typical progressing cavity pump drive head 12, a wellhead frame 14, a stuffing box 16, an electric motor 18, and a belt and sheave drive system 20, all mounted on a flow tee 22. The flow tee is shown with a blowout preventer 24 which is, in turn, mounted on a wellhead 25. The drive head 12 supports and drives a drive shaft 26, generally known as a "polished rod". The polished rod is supported and rotated by means of a polish rod clamp 28, which engages an output shaft 30 of the drive head by means of milled slots (not shown) in both parts. Wellhead frame 14 may be open sided in order to expose polished rod 26 to allow a service crew to install a safety clamp on the polished rod and then perform maintenance work on stuffing box 16. Polished rod 26 rotationally drives a drive string 32, sometimes referred to as a sucker rod, which, in turn, drives a progressing cavity pump 34 located at the bottom of the installation to produce well fluids to the surface through the wellhead.

FIG. 1B illustrates a typical progressing cavity pump drive head 36 with an integral stuffing box 38 mounted on the bottom of the drive head and corresponding to the portion of the installation in FIG. 1A that is above the dotted and dashed line 40. An advantage of this type of drive head is that, since the main drive head shaft is already supported with bearings, stuffing box seals can be placed around the main shaft, thus improving alignment and eliminating contact between the stuffing box rotary seals and the polished rod. This style of drive head may also reduce the height of the installation because there is no wellhead frame, and also may reduce cost because there are fewer parts since the stuffing box is integrated with the drive head. A disadvantage is that the drive head must be removed to do maintenance work on the stuffing box. Surface drive heads for progressing cavity pumps require a stuffing box to seal crude oil from leaking onto the ground where the polished rod passes from the crude oil passage in the wellhead to the drive head.

Figure 2A:
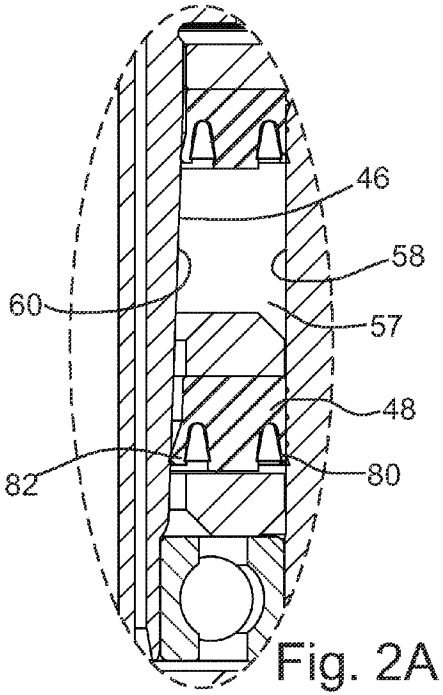
FIG. 2A is an exploded view of the portion, denoted by reference character 2A, of the stuffing box of FIG. 2.
Figure 2B:
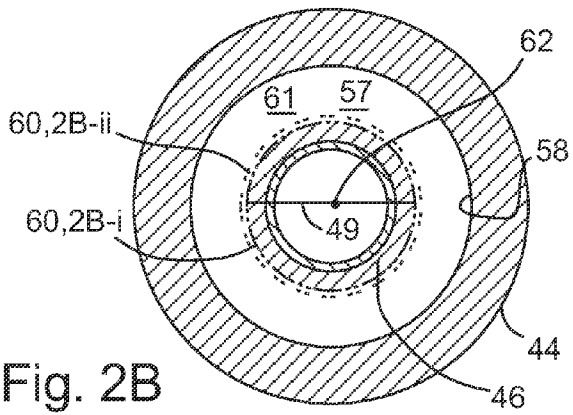
FIG. 2B is a section view taken along the 2B-i and 2B-ii section lines from FIG. 2, with the dynamic seal not shown for ease of illustration. Dashed lines are used to indicate the different proportions of the outer surface of the tubular shaft between the 2B-i and 2B-ii sections.
Figure 2:
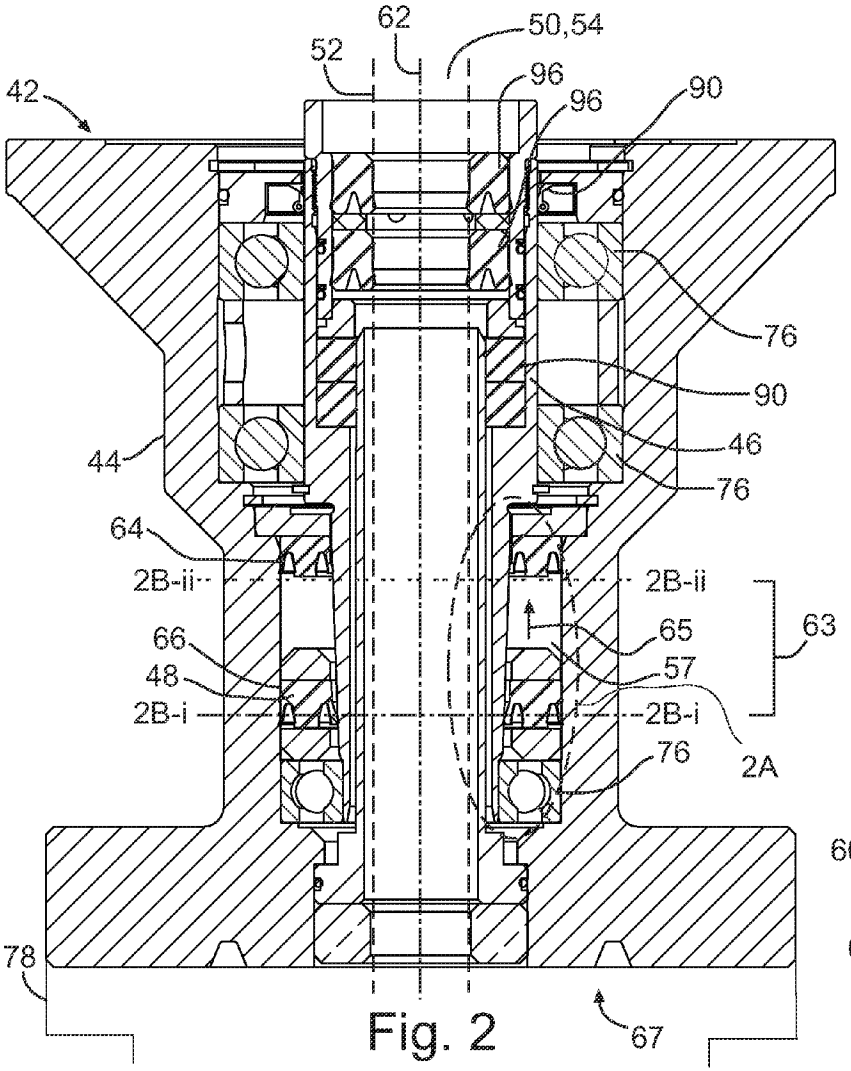
FIG. 2 is a side elevation view, in section, of a stuffing box with a tapered outer bore on the tubular shaft for sealing with a dynamic seal.
Figure 4:
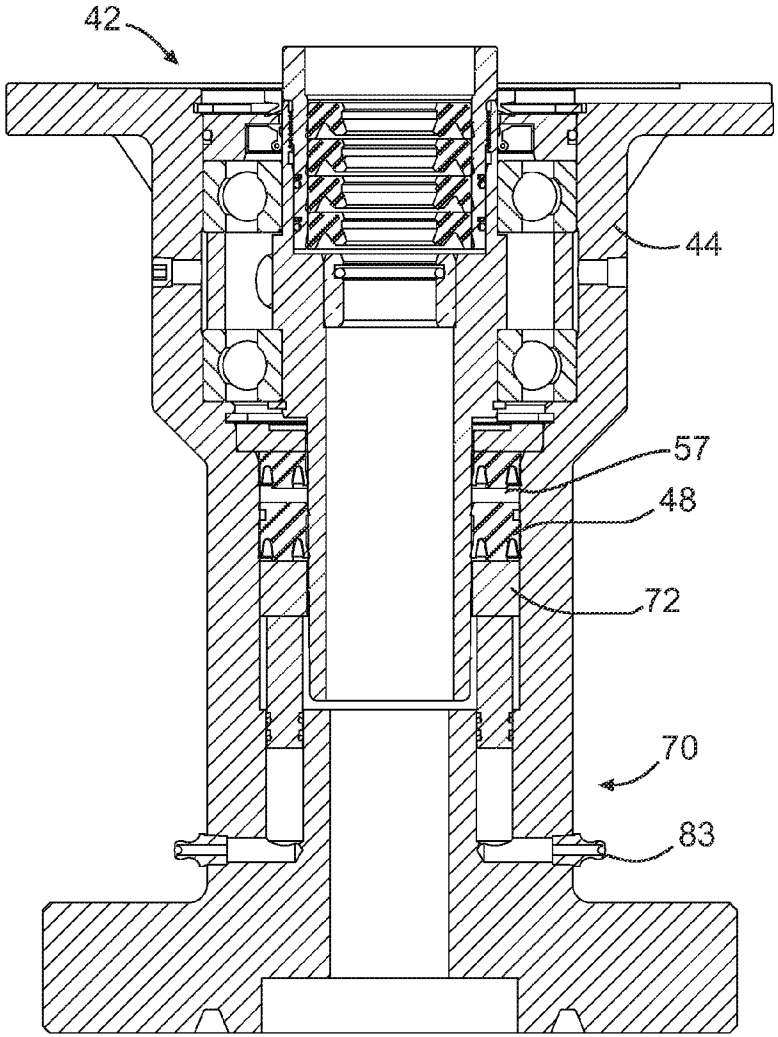
FIGS. 3 and 4 are side elevation views, in section, of a stuffing box, that illustrate different positions of a hydraulic seal positioner.
Figure 3:
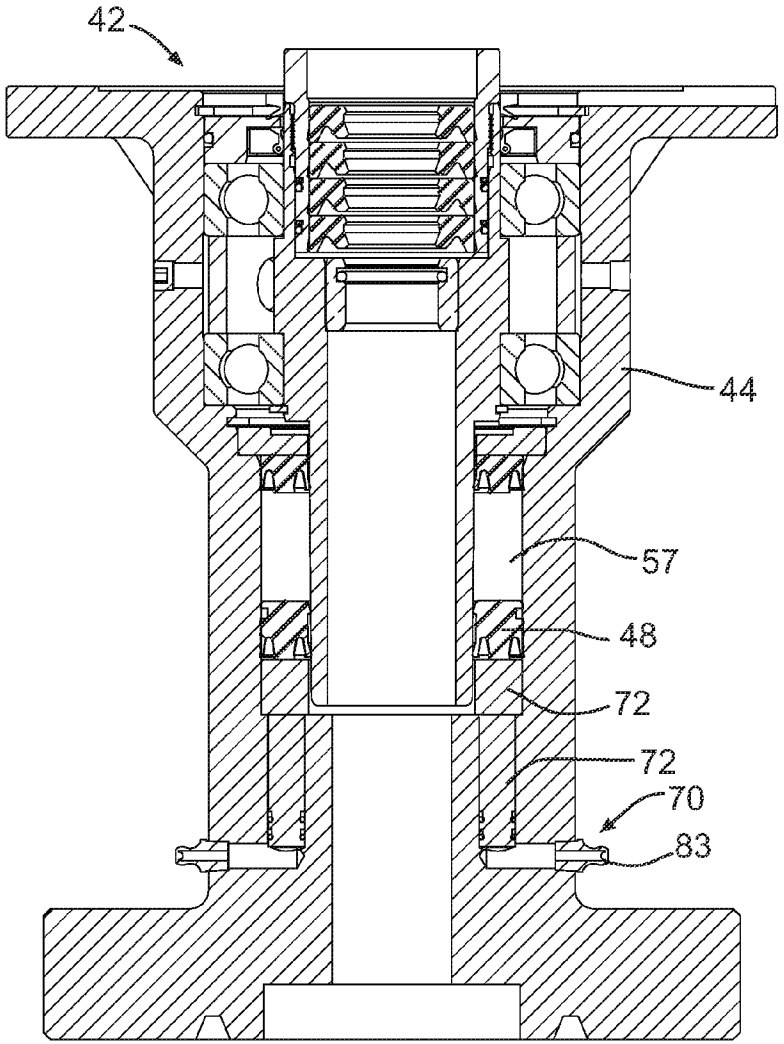

Referring to FIG. 2, a stuffing box 42 is illustrated according to the embodiments disclosed herein. Stuffing box 42 comprises a stationary housing 44, a tubular shaft 46, and a dynamic pressure seal 48. Housing 44 defines a passage 50, for example a bore, for receiving a well tubular 52. Tubular shaft 46 is mounted on the stationary housing 44 for rotation within the passage 50. Tubular shaft 46 defines an inner axial bore 54 adapted to form a static seal around well tubular 52 in use. Thus, tubular shaft 46 rotates with well tubular 52 in use.

Referring to FIGS. 2 and 2B, the dynamic pressure seal 48 (shown in FIG. 2 only, since the dynamic seal is not shown in FIG. 2B for ease of illustration) are mounted within an annular cavity 57 defined by respective cylindrical surfaces 58 and 60 of the stationary housing 44 and tubular shaft 46. One or both of the respective cylindrical surfaces 58 and 60, in this case outwardly facing surface 60, are tapered to decrease the radial cross sectional area 61 (FIG. 2B) of a seal travel portion 63 (FIG. 2) of the annular cavity 57 in an axial direction 65 downstream from a well end 67 of the stuffing box 42. In the example shown in FIG. 2, surface 60 of the tubular shaft 46 is tapered outwardly in axial direction 65 downstream from well end 67. A tapered cylindrical surface forms a truncated cone, so that the one or both of the respective cylindrical surfaces 58 and 60 are conical in shape.

FIG. 2B illustrates in dashed lines the different dimensions of surface 60 between the 2B-i and 2B-ii sections, taken from FIG. 2, that illustrate the corresponding downstream decrease in cross sectional area 61 between surfaces 58 and 60. The axial direction 65 is understood to be defined relative to a bore axis 62 of the stuffing box 42, and downstream is understood to be defined relative to the flow of fluids through the stuffing box 42 from the well end 67. A portion or the entirety of seal travel portion 63 may be tapered.

As stuffing box 42 is used, dynamic seal 48 experiences wear and a corresponding reduction in seal cross sectional area as material is stripped off of seal 48. Normally, when a seal 48 wears past a certain point, leakage occurs across seal 48, leading ultimately to failure of the stuffing box 42 to contain well fluids. However, by tapering the annular cavity 57 in the manner illustrated, the dynamic seal 48 is able to automatically reposition itself to compensate for wear during use. Thus, for example as dynamic seal 48 is effectively reamed across an inner lip 82 to increase a minimum inner sealing dimension 49 (FIG. 2B), pressure from well bore fluids presses the worn seal 48 upwards within cavity 57 where the worn seal 48 is able to seat with a relatively tighter fit within the narrower confines of cavity 57 downstream from the initial position of the seal 48. Thus, the lifespan of both the seal 48 and the stuffing box 42 are increased.

Figure 7A:
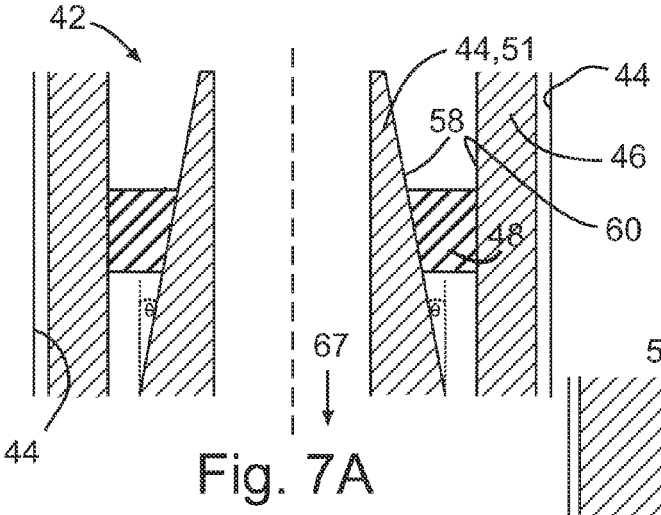
FIGS. 7A-D are side elevation views, in section, of portions of various stuffing box embodiments illustrating the annular cavity and dynamic seal between the tubular shaft and stationary housing.
Figure 7B:
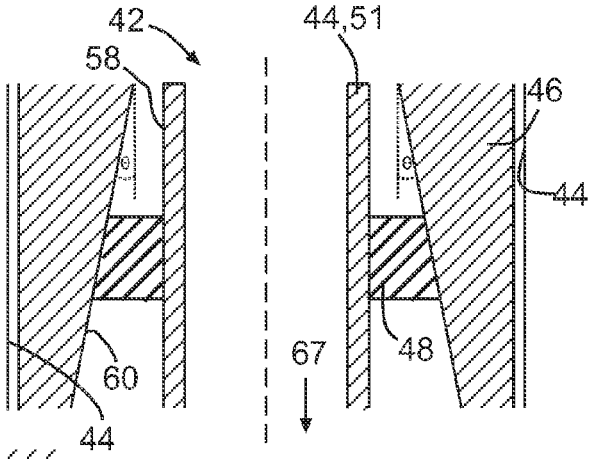
Figure 7C:
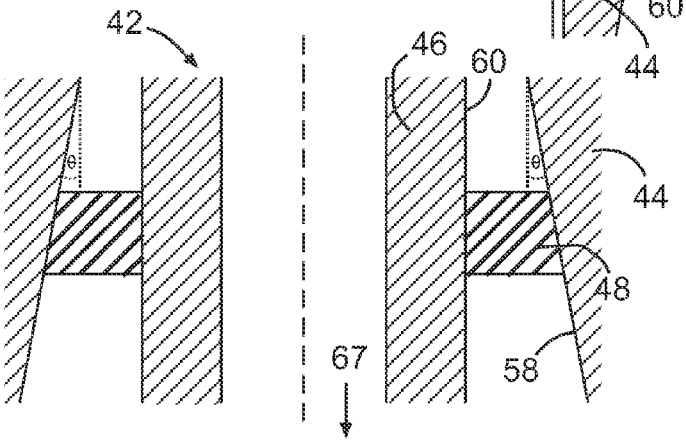
Figure 7D:
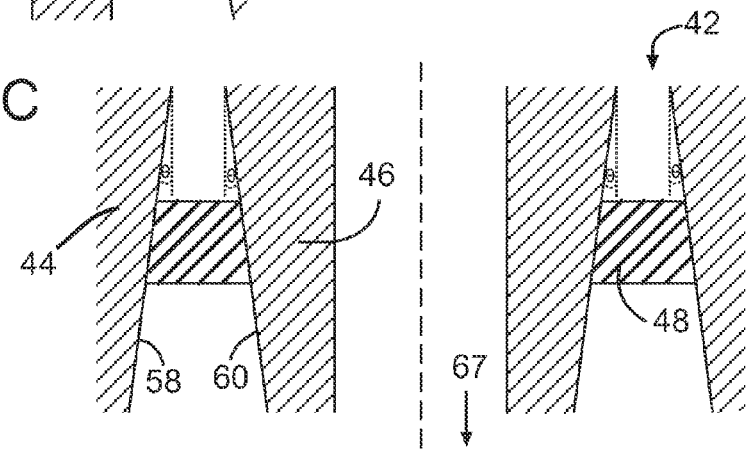

As shown in FIG. 2, the respective cylindrical surface 60 of the tubular shaft 46 is outward facing and the respective cylindrical surface 58 of the stationary housing 44 is inward facing. Referring to FIGS. 7A-B, this orientation may be reversed, for example if dynamic seal 48 seals between an inner standpipe 51 of housing 44. Referring to FIGS. 7A-D, various combinations of tapering of surfaces 58 and 60 may be used. For example, surface 58 may be tapered (FIG. 7B), surface 60 may be tapered (FIGS. 7A, 7C), or both surfaces 58 and 60 may be tapered (FIG. 7D).

Referring to FIG. 2, the dynamic pressure seal 48 may comprise one or both an upper pressure seal 64 and a lower pressure seal 66. Additional seals 48 may be used. The dynamic seal 48 is considered to be a pressure seal because fluid pressure from wellbore fluids energizes and wedges seal 48 downstream within cavity 57, creating a stronger seal at higher pressures. By contrast, placing seal 48 within a cavity 57 of uniform cross sectional area 61 in axial direction 65 does not generally allow seal 48 to act as a pressure seal and thus is prone to leakage after a certain amount of seal 48 wear.

Referring to FIGS. 3-6, a seal positioner 70 may be provided for adjustment, for example manual adjustment, of the position of the dynamic pressure seal 48 within the annular cavity 57. Seal positioner 70 may comprise one or more pistons 72, for example upstream of the dynamic pressure seal 48 to allow seal 48 to be pressed downstream within cavity 57 to ensure that seal 48 seats sufficiently within cavity 57. Piston 72 may be positioned at least partially within cavity 57 as shown, and may be an axial piston as shown. Piston 72 may be an annular or non-annular piston. In some cases seal positioner 70 may incorporate a biasing device, for example a spring for compressing seal 48 or piston 72 against seal 48 in use.

The seal positioner 70 may be a hydraulic seal positioner (FIGS. 3-4), for example with a hydraulic fluid input 83 in the stationary housing 44. Fluid input 83 may be a valve such as a one-way valve (not shown) for connection to a hydraulic fluid source (not shown), such as an air compressor. Thus, supply or application of hydraulic fluids compresses piston 72 against seal 48 and advances seal 48 downstream within cavity 57 as shown in the sequence from FIGS. 3-4.

Figure 6:
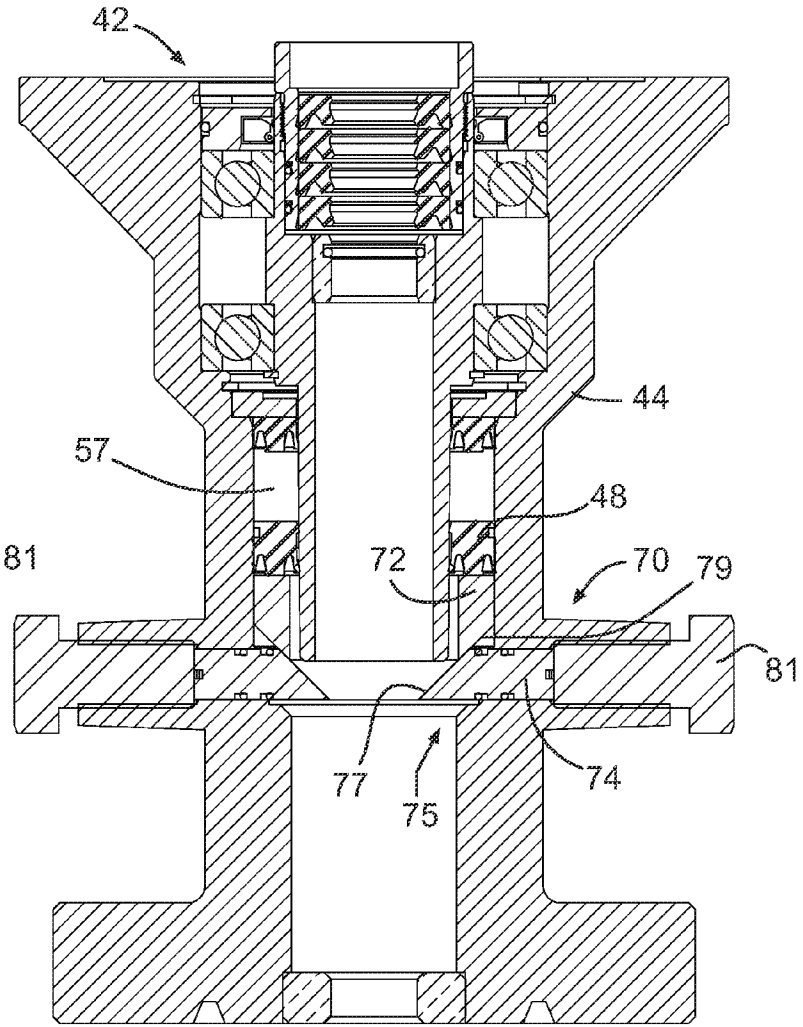
FIGS. 5 and 6 are side elevation views, in section, of a stuffing box, that illustrate different positions of a threaded rod seal positioner.
Figure 5:
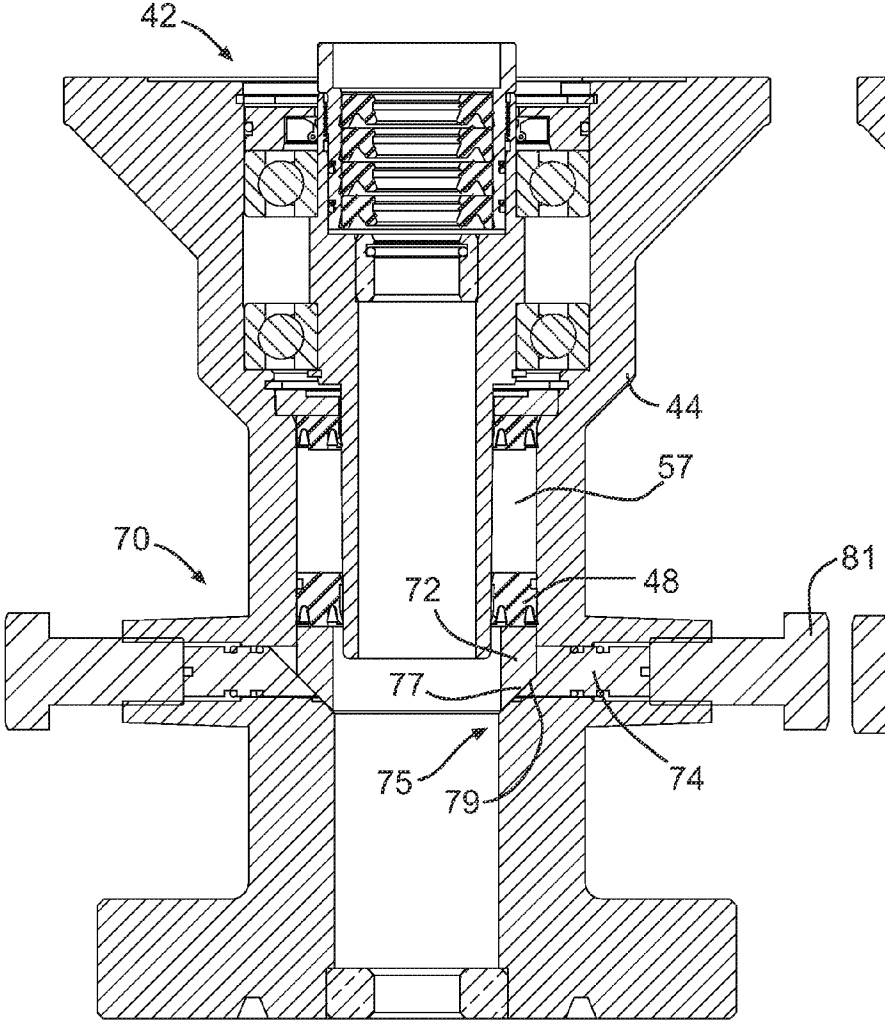

The seal positioner 70 may comprise a wedge, for example piston 74 connected for lateral force transfer to piston 72 (FIGS. 5-6). For example, a tapered end 77 of piston 74 contacts a tapered end 79 of piston 72 in order to allow lateral, and in this case axial, displacement of piston 72 against seal 48. A threaded rod 81 may be mounted in the stationary housing 44, for example to provide lateral force into piston 74 as shown in the sequence from FIGS. 5 and 6. In some embodiments, zero, one, two, or more pistons may be used with seal positioner 70.

Referring to FIG. 2, one or more set of bearings 76 may be provided between the stationary housing 44 and the tubular shaft 46. Bearings 76 reduce the amount of friction generation associated with rotation of tubular shaft 46 within stationary housing 44, and thus increase seal and component life.

Referring to FIG. 2, an example of a dynamic pressure seal 48 is illustrated. Seal 48 may comprise one or more of a packing seal, lip seal, or other suitable seal, although a lip seal is illustrated here with outer and inner lips 80 and 82, respectively. O-rings (not shown) may be incorporated as seals as well. Lips 80 and 82 flex under compression to form a sufficient seal against surfaces 58 and 60 when under wellbore fluid pressure and when positioned within cavity 57. Lip seals may be advantageous for use as dynamic seals, because of the reduced contact area afforded by a lip seal, thus reducing friction even under relatively high pressures. Seal 48 may be designed to seal at high and low pressures. Thus, seal 48 may be designed to handle high pressure abrasive crude oil for example in a progressing cavity pumping application, while also being designed to seal low pressure slurry for example in a transfer application. Seal positioner 70 (FIGS. 3-6) is advantageous for low pressure applications. Pressure seal 48 should be suitable for dynamic sealing applications, and may be hardened or adapted for long-term dynamic use.

Stuffing box 42 may be used for production of wellbore fluids, such as production in a progressing cavity pumping application. As shown in FIG. 2, stuffing box 42 may be adapted to be retrofitted into a wellhead 78, for example below the drive head (not shown). In other cases stuffing box 42 may be adapted for an integral application, for example in the style shown in FIG. 1B.

Referring to FIG. 2, it should be understood that various other components may be incorporated into stuffing box 42. For example, secondary seals 90 may provided at various points between tubular shaft 46 and housing 44.

In general, where the word seal is mentioned in this document, one or more seals may be provided to effectively operate as a single seal, for example observed in the stacking of plural lip seals 96 provided as the stationary seals for sealing against well tubular 52 in use. In addition, it should be understood that various other components may be provided with the stuffing box 42 for various wellhead applications to be carried out. For example, wellhead 78 may include any one or more of the other components illustrated in FIG. 1A. In some applications, a drive head may rotate a well tubular 52, while other applications may incorporate a pump jack attached to reciprocate well tubular 52 as a polished rod. Stuffing box 42 may also be used for injection or pulling of tubulars, for example in a coiled tubing application. Stuffing box 42 may also be used in a slew pump application. Stuffing box 42 may incorporate a lubrication system (not shown) for lubricating various components, such as the dynamic pressure seal 48.

Various components discussed herein may include various sub-components, such as the plural sleeves that thread together to make up the tubular shaft 46 of FIG. 1. Connections between components, or the mounting of one component to another, may be done through intermediate parts.

Figures may not be drawn to scale, and may have dimensions exaggerated to indicate relative angles between surfaces and components. The θ symbol indicates a non zero angle relative to the bore axis 62 of stuffing box 42. Suitable tapers within the annular cavity may have angles of up to and above one degree relative to bore axis 62.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A stuffing box for a wellhead, the stuffing box comprising:

a stationary housing defining a passage for receiving a well tubular, the stationary housing having a well end and a second end opposite the well end;

a tubular shaft mounted on the stationary housing for rotation within the passage and defining an inner axial bore adapted to form a static seal around a well tubular in use; and a dynamic pressure seal mounted within a seal travel portion of an annular cavity defined by respective cylindrical surfaces of the stationary housing and tubular shaft, the seal travel portion of the annular cavity has a radial cross sectional area that decreases with increasing distance along a direction of flow from the well end of the stationary housing to the second end.

2. The stuffing box of claim 1 in which the respective cylindrical surface of the tubular shaft is outward facing and the respective cylindrical surface of the stationary housing is inward facing.

3. The stuffing box of claim 2 in which, along at least part of the seal travel portion, the respective cylindrical surface of the tubular shaft is tapered outwardly with increasing distance along the direction of flow from the well end of the stationary housing to the second end.

4. The stuffing box of claim 1 in which the respective cylindrical surface of the tubular shaft is inward facing and the respective cylindrical surface of the stationary housing is outward facing.

5. The stuffing box of claim 1 further comprising a seal positioner for adjustment of the position of the dynamic pressure seal within the annular cavity.

6. The stuffing box of claim 5 in which the seal positioner comprises a piston.

7. The stuffing box of claim 6 in which the seal positioner is upstream of the dynamic pressure seal.

8. The stuffing box of claim 5 in which the seal positioner comprises a wedge.

9. The stuffing box of claim 5 in which the seal positioner is a hydraulic seal positioner.

10. The stuffing box of claim 9 in which the hydraulic seal positioner has a hydraulic fluid input in the stationary housing.

11. The stuffing box of claim 5 in which the seal positioner further comprises a threaded rod mounted in the stationary housing.

12. The stuffing box of claim 1 in which the stuffing box is adapted for production of wellbore fluids.

13. The stuffing box of claim 12 in which the stuffing box is adapted for use in a progressing cavity pump application.

14. The stuffing box of claim 1 in which the dynamic pressure seal comprises a lip seal.

15. The stuffing box of claim 1 further comprising bearings between the stationary housing and the tubular shaft.

* * * * *